US006616141B2

(12) United States Patent
Diamant

(10) Patent No.: US 6,616,141 B2
(45) Date of Patent: Sep. 9, 2003

(54) FOLDABLE PLAY-TABLE MULTI-GAME ASSEMBLY

(75) Inventor: Asher Diamant, Holon (IL)

(73) Assignee: Diamant Toys LTD, Ashdod (IL)

( * ) Notice: Subject to any disclaimer, the term of this patent is extended or adjusted under 35 U.S.C. 154(b) by 0 days.

(21) Appl. No.: 09/863,163

(22) Filed: May 23, 2001

(65) Prior Publication Data

US 2001/0055993 A1 Dec. 27, 2001

(30) Foreign Application Priority Data

May 25, 2000 (GB) ..... 0012802

(51) Int. Cl.[7] ..... A63F 7/07; A63F 9/00; A63D 15/04; A47C 17/62; A63B 67/04

(52) U.S. Cl. ..... 273/108.1; 473/10; 473/496; 273/309; 273/108.5; 273/108.21

(58) Field of Search ..... 273/317, 317.1, 273/108, 108.1, 108.4, 108.41, 108.5, 108.51, 108.52, 108.53, 108.54, 108.55, 108.56, 108.57, 109, 309; 473/1, 9, 10, 475, FOR 112, FOR 113

(56) References Cited

U.S. PATENT DOCUMENTS

| | | | | | |
|---|---|---|---|---|---|
| 614,722 | A | * | 11/1898 | Isaacs | 273/309 |
| 1,443,266 | A | * | 1/1923 | King | 473/32 |
| 1,819,932 | A | * | 8/1931 | Walden | 273/317.3 |
| D223,538 | S | * | 5/1972 | Manning | 473/18 |
| 3,825,264 | A | * | 7/1974 | Dockum | 273/126 R |
| 4,474,374 | A | * | 10/1984 | Lewis et al. | 473/14 |
| 4,872,679 | A | | 10/1989 | Bohaski et al. | |
| 4,995,611 | A | * | 2/1991 | Goldthorpe | 273/123 R |
| 5,069,460 | A | * | 12/1991 | Kulesza | 273/108.22 |
| 5,112,047 | A | | 5/1992 | Monneret | |
| 5,556,094 | A | * | 9/1996 | Shiledar Baxi | 273/108.5 |
| 5,630,760 | A | | 5/1997 | Brown et al. | |
| 6,349,939 | B1 | * | 2/2002 | Tsai | 273/108.1 |
| 6,419,224 | B1 | * | 7/2002 | Tsai | 473/10 |

* cited by examiner

*Primary Examiner*—Paul T. Sewell
*Assistant Examiner*—Mitra Aryanpour
(74) *Attorney, Agent, or Firm*—Woodcock Washburn LLP

(57) ABSTRACT

A play-table game assembly characterized by a support surface which includes two halves hinged together by a hinge, the support surface having a first orientation in which the two halves are folded towards each other along the hinge, and a second orientation in which the two halves are pivoted about the hinge to form a generally flat plane, each of the halves including a rim such that in the first orientation a storage volume is defined and bounded by the support surface and by the rims folded towards each other, and in the second orientation a user area is defined on the flat plane, a plurality of leg-mounting holes formed at corners of the support surface, formed on one face of the support surface and on an opposite face thereof, at least one playing surface adapted to be placed on at least one of the faces of the support surface when the support surface is in the second orientation, a plurality of legs adapted to be selectively secured to the leg-mounting holes on at least one of the faces of the support surface, the legs being storable inside the storage volume, and a plurality of game accessories adapted to be selectively secured to at least one of the support surface and the at least one playing surface, the game accessories being storable inside the storage volume.

8 Claims, 8 Drawing Sheets

FOLDABLE PLAY-TABLE MULTI-GAME ASSEMBLY

FIELD OF THE INVENTION

The present invention relates generally to play-table game assemblies, and particularly to a foldable play-table multi-game assembly.

BACKGROUND OF THE INVENTION

There are many well known and familiar games played on play-tables, such as football (soccer), speed hockey, billiards, etc. Generally the play-table is supported by four legs, and has a playing surface that is convertible from one game to another. For example, a billiards playing surface may be replaced by a hockey playing surface, and so forth. The overall dimensions of the table assembly may be in the range of 100–120 cm, or about 39¼–47¼ inches, in length, and 60–80 cm, or about 23½–31½ inches, in both width and height, although other sizes are also known.

In order to provide a sturdy game surface, which is especially important for games like billiards, such play-table game assemblies are generally permanent structures. This means that once the table assembly is assembled in a room, it becomes a permanent fixture in the room. Unfortunately, the assembly occupies a relatively large volume, tending to overcrowd the room. The relatively large assembly is also unwieldy to transport, and takes up valuable volume when shipping or bringing home from a store.

SUMMARY OF THE INVENTION

The present invention seeks to provide a unique, foldable play-table multi-game assembly. The present invention solves the abovementioned problems of the prior art by constructing the assembly to be foldable and compact for storage, handling and transportation, and yet sturdy and level for game playing. The assembly can be converted from a regular table (for reading or writing) to a variety of games, including, but not limited to, football, billiards, speed hockey, basketball and table tennis.

It is noted that the term billiards as used in the specification and claims, includes billiards, snooker, pool and the like.

There is thus provided in accordance with a preferred embodiment of the present invention a play-table game assembly characterized by a support surface which includes two halves hinged together by a hinge, the support surface having a first orientation in which the two halves are folded towards each other along the hinge, and a second orientation in which the two halves are pivoted about the hinge to form a generally flat plane, each of the halves including a rim such that in the first orientation a storage volume is defined and bounded by the support surface and by the rims folded towards each other, and in the second orientation a user area is defined on the flat plane, a plurality of leg-mounting holes formed at corners of the support surface, formed on one face of the support surface and on an opposite face thereof, at least one playing surface adapted to be placed on at least one of the faces of the support surface when the support surface is in the second orientation, a plurality of legs adapted to be selectively secured to the leg-mounting holes on at least one of the faces of the support surface, the legs being storable inside the storage volume, and a plurality of game accessories adapted to be selectively secured to at least one of the support surface and the at least one playing surface, the game accessories being storable inside the storage volume.

In accordance with a preferred embodiment of the present invention there is also provided a handle and a clasp assembly attached to at least one of the two halves of the support surface, for closing and carrying the game assembly in the first orientation.

Further in accordance with a preferred embodiment of the present invention the at least one playing surface includes a football playing surface, and the game accessories include a plurality of rods rotatably attached to a support frame, a plurality of players attached to the rods, and a pair of goals placed at opposite ends of the playing surface.

Still further in accordance with a preferred embodiment of the present invention the at least one playing surface includes a billiards playing surface, and the game accessories include at least one billiards cue and a plurality of billiards balls, wherein the leg-mounting holes serve as billiards pockets.

Additionally in accordance with a preferred embodiment of the present invention the at least one playing surface includes a speed hockey playing surface, and the game accessories include a puck, a pair of striking discs, and a pair of goals placed at opposite ends of the playing surface.

Further in accordance with a preferred embodiment of the present invention the at least one playing surface includes a basketball playing surface, and the game accessories include a basketball, a backboard mounted on a pole, a rim attached to the backboard, and a net hanging from the rim, the pole being inserted into one of the leg-mounting holes.

Still further in accordance with a preferred embodiment of the present invention the at least one playing surface includes a table tennis playing surface, and the game accessories include a pair of paddles, a table tennis ball and a net attached to the playing surface.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1A:
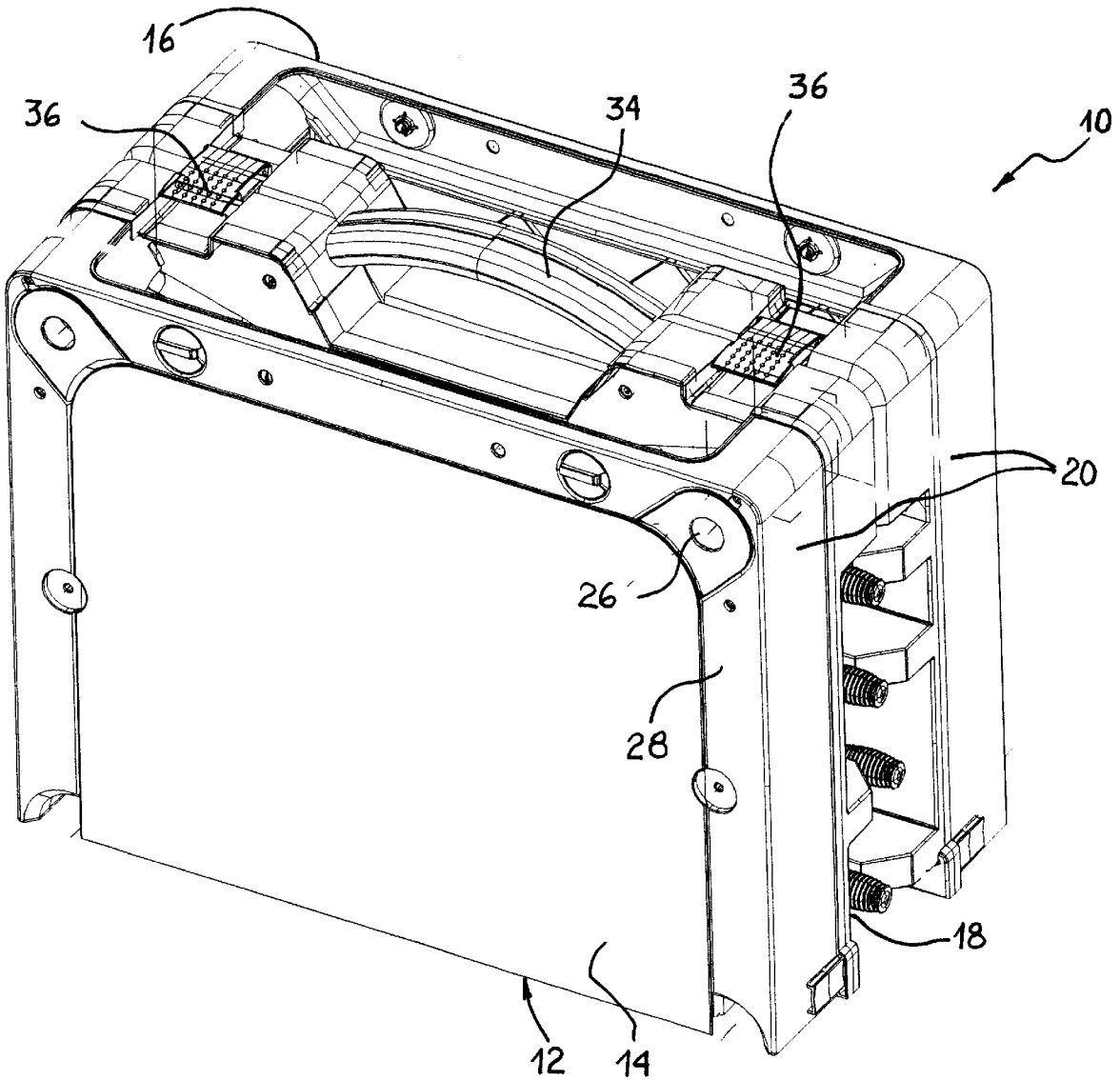
FIG. 1A is a simplified pictorial illustration of a play-table game assembly, constructed and operative in accordance with a preferred embodiment of the present invention, in a folded orientation.
Figure 1B:
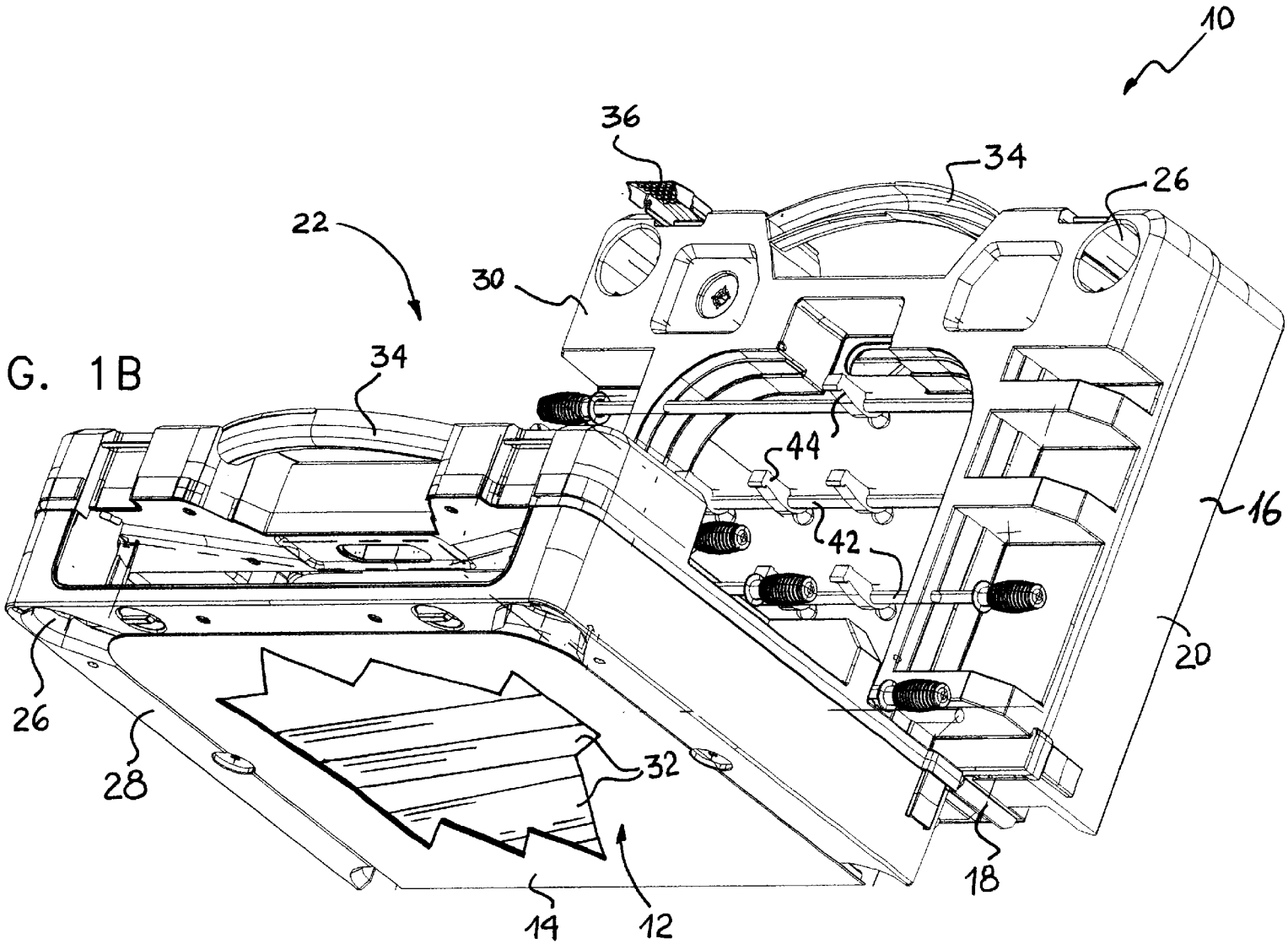
FIG. 1B is a simplified pictorial illustration of the play-table game assembly of FIG. 1A, being unfolded.
Figure 1C:
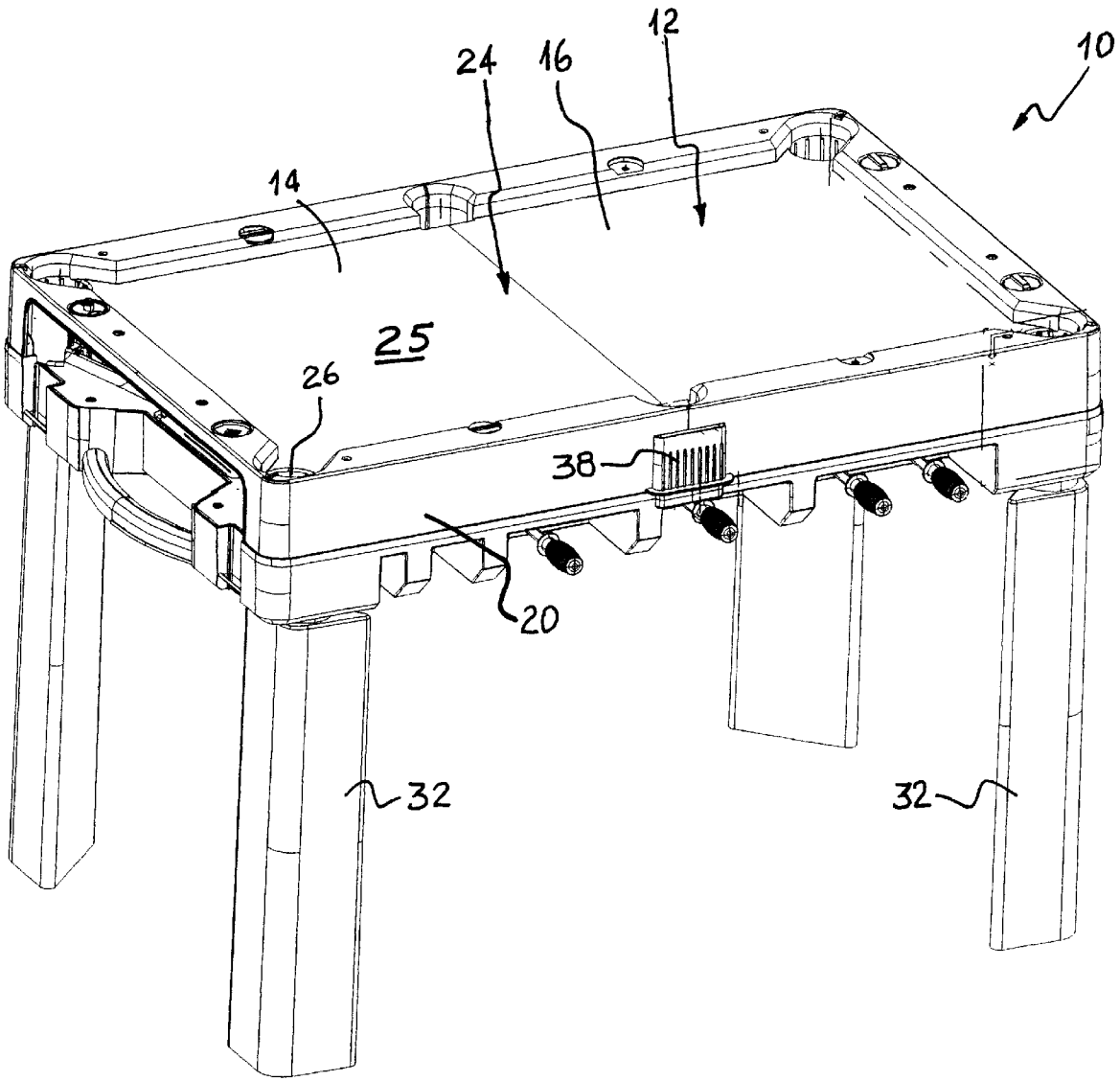
FIG. 1C is a simplified pictorial illustration of the play-table game assembly of FIG. 1A in an unfolded orientation, with legs assembled thereto.

Reference is now made to FIGS. 1A–1C which illustrate a play-table game assembly 10, constructed and operative in accordance with a preferred embodiment of the present invention.

Game assembly 10 preferably includes a support surface 12 which includes two halves 14 and 16, preferably hinged together by a hinge 18. Each of the halves 14 and 16 preferably includes a rim 20. In FIG. 1A, support surface 12 is shown in a first orientation in which the two halves 14 and 16 are folded towards each other along hinge 18. In the first orientation, a storage volume 22 (hidden from view in FIG. 1A, but seen in the partially open orientation shown in FIG. 1B) is defined and bounded by support surface 12 and by rims 20 folded towards each other. In FIG. 1C, support surface 12 is shown in a second orientation in which the two halves 14 and 16 are pivoted about hinge 18 to form a generally flat plane 24. The flat plane 24 defines a user area 25, which can be used as a table for writing or playing, for example, and for supporting a playing surface, as is described further hereinbelow.

A plurality of leg-mounting holes 26 are preferably formed at corners of support surface 12. Preferably some of the holes 26 are formed on one face 28 of support surface 12 and others are formed on an opposite face 30 thereof. A plurality of legs 32 are preferably adapted to be selectively secured to leg-mounting holes 26 on either of the faces 28 and 30 of support surface 12, as is described further in detail hereinbelow. As seen in FIG. 1B, legs 32 are preferably storable inside storage volume 22. Also stored in storage volume 22, are one or more playing surfaces adapted to be placed on one of the faces 28 and 30 of support surface 12 when support surface 12 is in the second (i.e., playing) orientation, as well as a plurality of game accessories adapted to be selectively secured to support surface 12 or the playing surfaces, as is described further in detail hereinbelow.

As seen in FIG. 1A, a handle 34 and a clasp assembly 36 are preferably attached to one or both of the two halves 14 and 16 of support surface 12, for closing and carrying game assembly 10 in the first orientation. Preferably a fastener 38 is provided that fastens the two halves 14 and 16 together in the second orientation, as seen in FIGS. 2–6.

Figure 2:
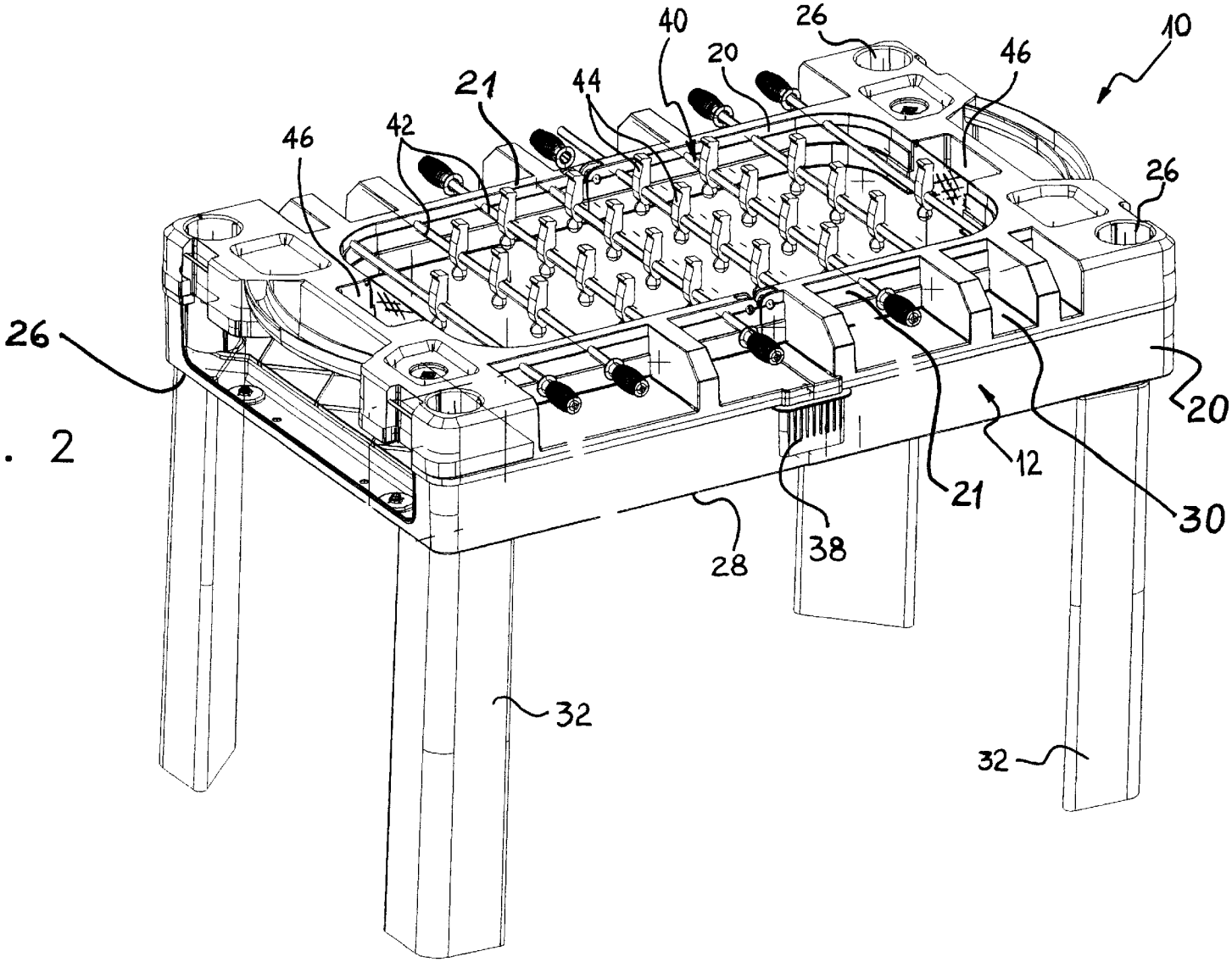
FIG. 2 is a simplified pictorial illustration of the play-table game assembly of FIG. 1A assembled for playing football, in accordance with a preferred embodiment of the present invention.

Reference is now made to FIGS. 2–6, which illustrate different playing surfaces of game assembly 10, in accordance with different preferred embodiments of the present invention. In FIG. 2, game assembly 10 includes a football playing surface 40. The game accessories preferably include a plurality of rods 42 rotatably attached to a support frame 21, a plurality of players 44 attached to rods 42, and a pair of goals 46 placed at opposite ends of playing surface 40. It is noted that in the embodiment of FIG. 2, the legs 32 are inserted in holes 26 from face 28 of support surface 12, whereas the holes 26 of face 30 face upwards.

Figure 3:
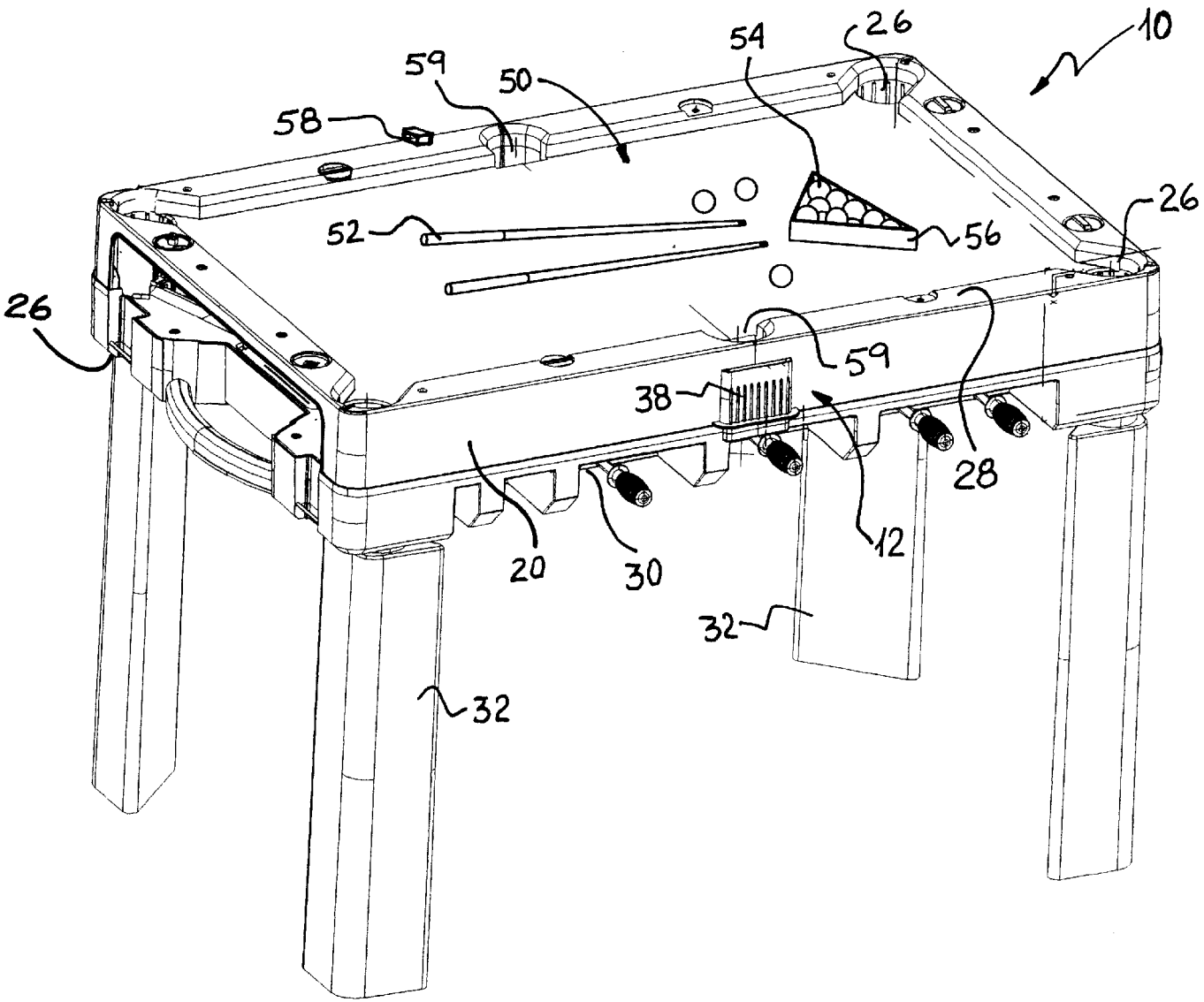
FIG. 3 is a simplified pictorial illustration of the play-table game assembly of FIG. 1A assembled for playing billiards, in accordance with a preferred embodiment of the present invention.

In FIG. 3, game assembly 10 includes a billiards playing surface 50. The game accessories preferably include one or more billiards cues 52 and a plurality of billiards balls 54. In addition, the accessories may include a triangle rack 56 and a chalk 58. In accordance with a preferred embodiment of the present invention, the leg-mounting holes 26 themselves serve as billiards pockets. Additional pockets 59 are preferably provided, formed in a portion of support surface 12.

Figure 4:
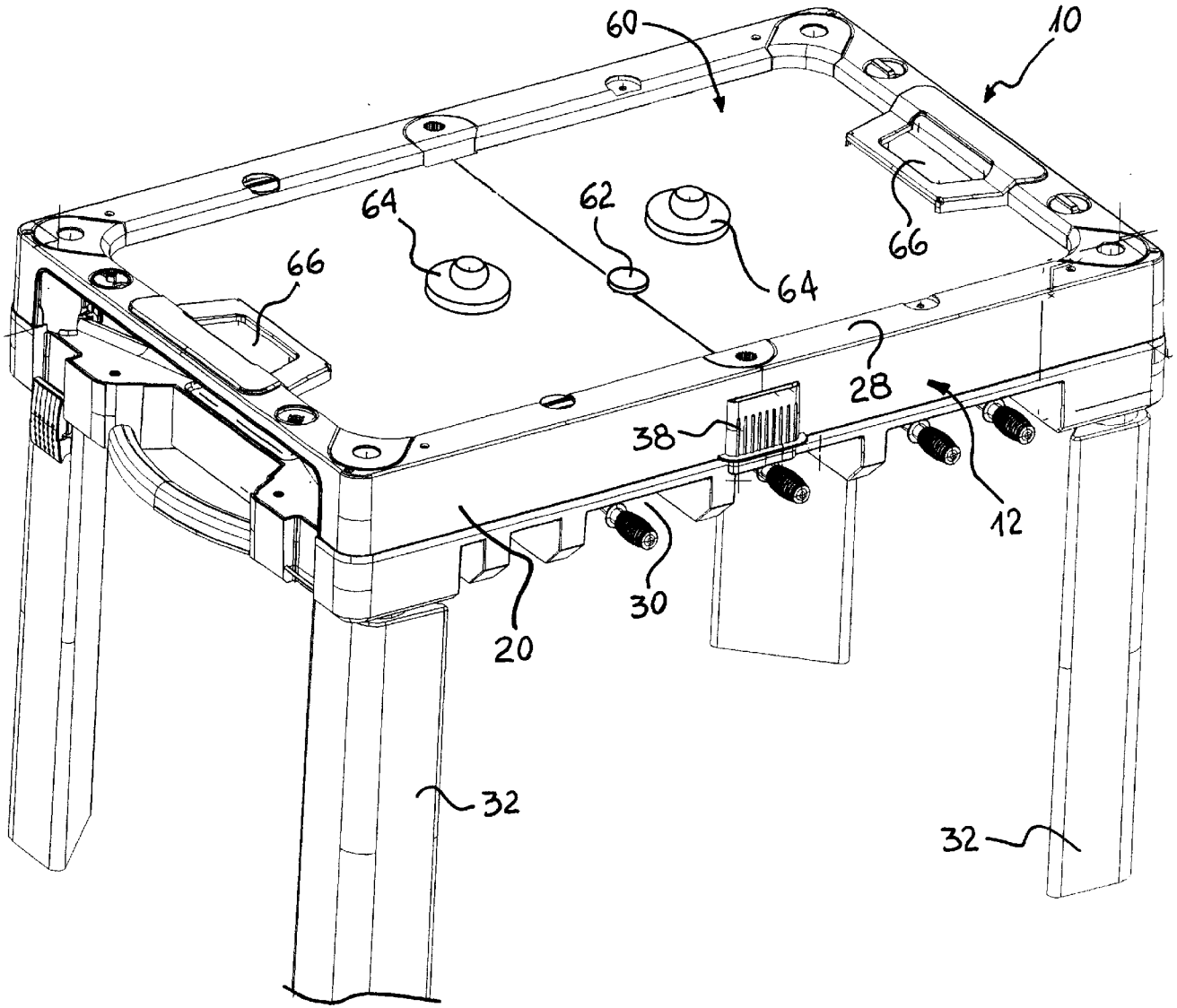
FIG. 4 is a simplified pictorial illustration of the play-table game assembly of FIG. 1A assembled for playing speed hockey, in accordance with a preferred embodiment of the present invention.

In FIG. 4, game assembly 10 includes a speed hockey playing surface 60. The game accessories preferably include a puck 62, a pair of striking discs 64, and a pair of goals 66 placed at opposite ends of playing surface 60.

Figure 5:
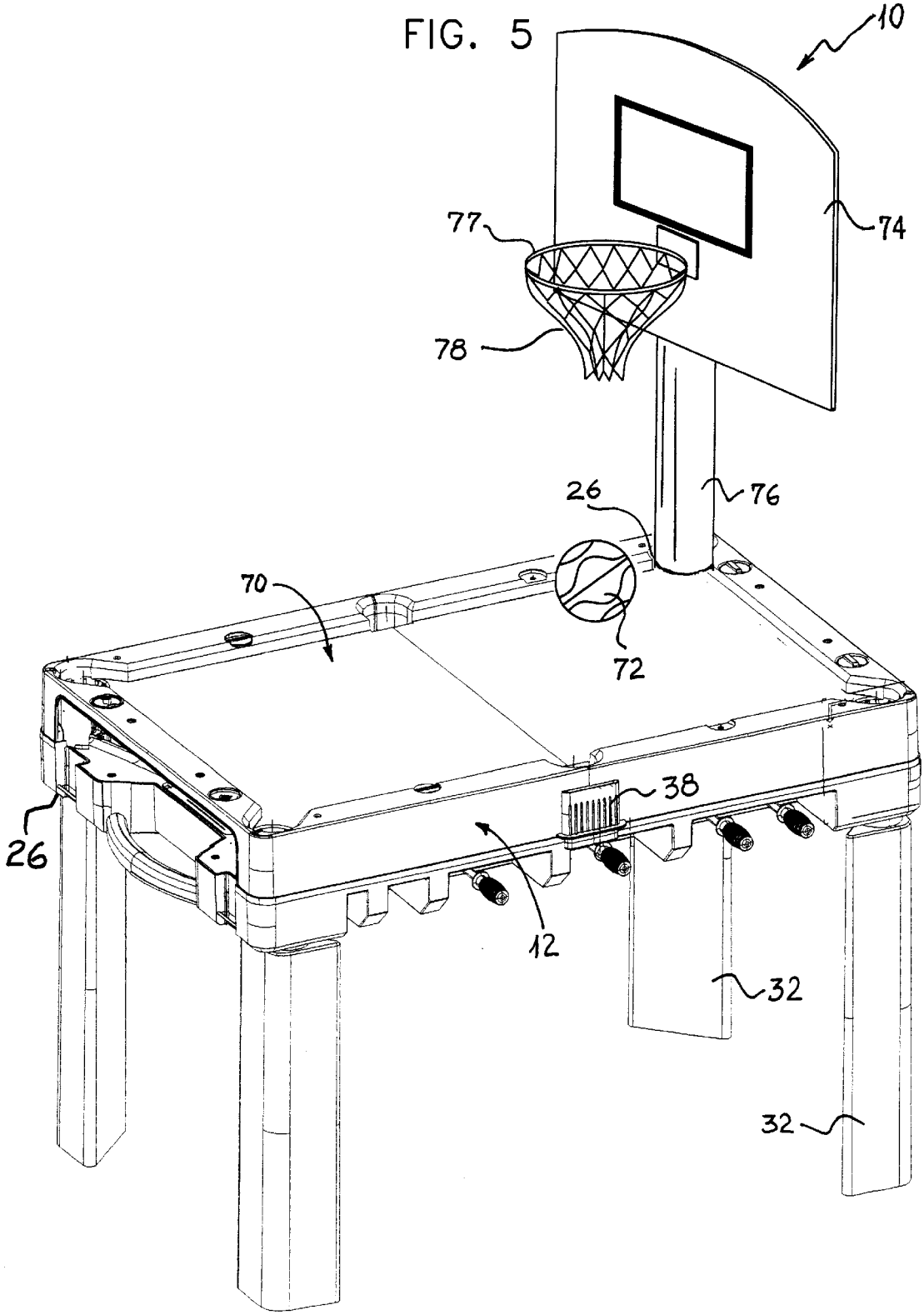
FIG. 5 is a simplified pictorial illustration of the play-table game assembly of FIG. 1A assembled for playing basketball, in accordance with a preferred embodiment of the present invention.

In FIG. 5, game assembly 10 includes a basketball playing surface 70. The game accessories preferably include a basketball 72, a backboard 74 mounted on a pole 76, and a rim 77, with a net 78 hanging therefrom, attached to backboard 74. In accordance with a preferred embodiment of the present invention, pole 76 is inserted into one of leg-mounting holes 26.

Figure 6:
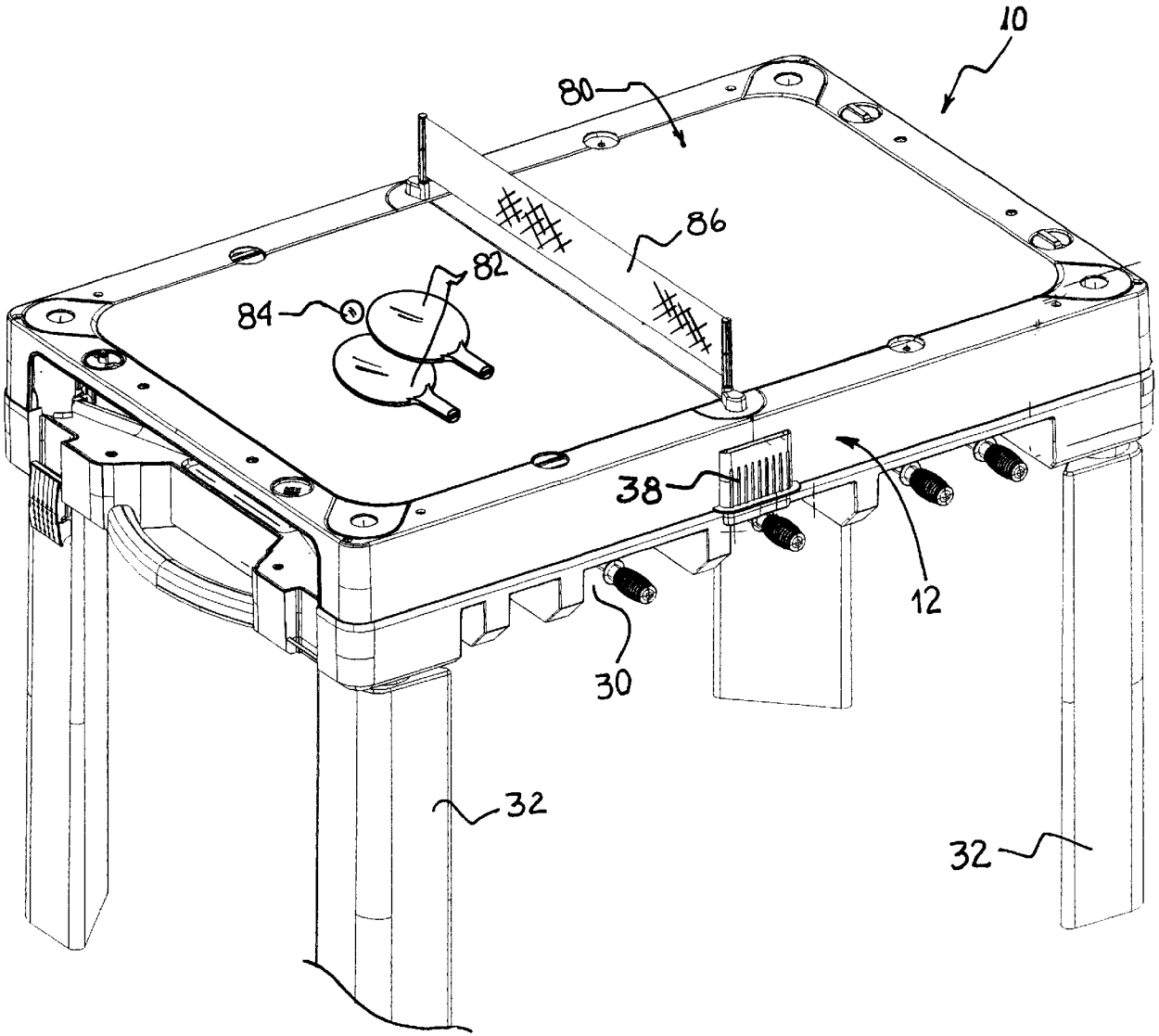
FIG. 6 is a simplified pictorial illustration of the play-table game assembly of FIG. 1A assembled for playing table tennis, in accordance with a preferred embodiment of the present invention.

In FIG. 6, game assembly 10 includes a table tennis playing surface 80. The game accessories preferably include a pair of paddles 82, a table tennis ball 84 and a net 86 attached to playing surface 80.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A play-table game assembly characterized by:

a support surface which comprises two halves hinged together by a hinge, the support surface having a first orientation in which the two halves are folded towards each other along said hinge, and a second orientation in which the two halves are pivoted about said hinge to form a generally flat plane, each of the halves comprising a rim such that in said first orientation a storage volume is defined and bounded by said support surface and by said rim folded towards each other, and in said second orientation a user area is defined on said flat plane;

a plurality of leg-mounting holes formed at corners of said support surface, formed on one face of said support surface and on an opposite face thereof;

at least one playing surface, adapted to be placed on at least one of said faces of said support surface when said support surface is in said second orientation, comprising:

a football playing surface; and a billiards playing surface;

a plurality of legs adapted to be selectively secured to said leg-mounting holes on at least one of said faces of said support surface, said legs being storable inside said storage volume; and a plurality of game accessories, adapted to be selectively secured to at least one of said support surface and said at least one playing surface, comprising:

a plurality of rods rotatably attached to a support frame;

a plurality of players attached to said rods;

a pair of goals placed at opposite ends of said playing surface;

at least one billiards cue; and a plurality of billiards balls, said game accessories being storable inside said storage volume, said leg-mounting holes serve as billiards pockets, and said billiards pockets are entirely contained within said rim.

2. The play-table game assembly according to claim 1 and further comprising a handle and a clasp assembly attached to at least one of the two halves of the support surface, for closing and carrying said game assembly in said first orientation.

3. The play-table game assembly according to claim 1 wherein said at least one playing surface comprises a speed hockey playing surface, and said game accessories comprise a puck, a pair of striking discs, and a pair of goals placed at opposite ends of said playing surface.

4. The play-table game assembly according to claim 2 wherein said at least one playing surface comprises a speed hockey playing surface, and said game accessories comprise a puck, a pair of striking discs, and a pair of goals placed at opposite ends of said playing surface.

5. The play-table game assembly according to claim 1 wherein said at least one playing surface comprises a basketball playing surface, and said game accessories comprise a basketball, a backboard mounted on a pole, a rim attached to said backboard, and a net hanging from said rim, said pole being inserted into one of said leg-mounting holes.

6. The play-table game assembly according to claim 2 wherein said at least one playing surface comprises a basketball playing surface, and said game accessories comprise a basketball, a backboard mounted on a pole, a rim attached to said backboard, and a net hanging from said rim, said pole being inserted into one of said leg-mounting holes.

7. The play-table game assembly according to claim 1 wherein said at least one playing surface comprises a table tennis playing surface, and said game accessories comprise a pair of paddles, a table tennis ball and a net attached to said playing surface.

8. The play-table game assembly according to claim 2 wherein said at least one playing surface comprises a table tennis playing surface, and said game accessories comprise a pair of paddles, a table tennis ball and a net attached to said playing surface.

* * * * *